US005098883A

United States Patent [19]

Aono

[11] Patent Number: 5,098,883

[45] Date of Patent: Mar. 24, 1992

[54] THERMAL TRANSFER IMAGE RECEIVING MATERIAL

[75] Inventor: Toshiaki Aono, Kanagawa, Japan

[73] Assignee: Fuji Photo Film Co., Ltd., Kanagawa, Japan

[21] Appl. No.: 510,765

[22] Filed: Apr. 18, 1990

[30] Foreign Application Priority Data

Apr. 20, 1989 [JP] Japan ..... 1-98709

[51] Int. Cl.[5] ..... B41M 5/035; B41M 5/26

[52] U.S. Cl. ..... 503/227; 428/195; 428/206; 428/327; 428/341; 428/342; 428/421; 428/422; 428/447; 428/452; 428/513; 428/913; 428/914

[58] Field of Search ..... 8/471; 428/195, 421, 428/422, 447, 913, 914, 206, 327, 341, 342, 452, 511-513; 503/227

[56] References Cited

U.S. PATENT DOCUMENTS 4,626,256 12/1986 Kawasaki et al. ..... 8/471

*Primary Examiner*—Bruce H. Hess

*Attorney, Agent, or Firm*—Sughrue, Mion, Zinn, Macpeak & Seas

[57] ABSTRACT

A thermal transfer image receiving material comprising a support having thereon at least one image receiving layer which can accept a dye to form an image, the dye migrating from a thermal transfer dye providing material when heated, wherein the material contains at least one layer on the image receiving layer-side of the support which contains fine solid particles of a fluorine compound and silicone oil.

30 Claims, No Drawings

THERMAL TRANSFER IMAGE RECEIVING MATERIAL

FIELD OF THE INVENTION

This invention relates to a thermal transfer image receiving material for use in thermal transfer methods using thermomobile type dyes. More particularly, this invention relates to a thermal transfer image receiving material which is improved in feedability and conveyability and has improved properties with respect to the problems of the heat fusion of thermal transfer dye providing materials to thermal transfer image receiving materials during the course of thermal transfer, the color migration by re-transfer of dyes from thermal transfer image receiving materials after transfer and the fading of dye image during storage over a long period of time.

BACKGROUND OF THE INVENTION

Various information processing systems have been developed as a result of the rapid development which have taken place in the information industry in recent years. Methods of recording and apparatus compatible with these information processing systems have been developed and adopted. Thermal transfer recording methods, i.e., recording methods of this type, involve the use of an apparatus which is light and compact, with which there is little noise, and which has excellent operability and maintenance characteristics. Moreover, since they also allow coloring to be achieved easily, these methods are the most widely used. Thermal transfer recording methods can be broadly classified into two types, namely, thermofusion types and thermomobile types. In the latter case, a thermal transfer dye providing material which has, on a support, a dye providing layer which contains a binder and a thermomobile dye is laminated with a thermal transfer image receiving material, heat is applied from the support side of the dye providing material, the thermomobile dye is transferred to the recording medium (thermal transfer image receiving material) in the form of a pattern corresponding to the heat pattern which has been applied, and an image is formed in this way.

Moreover, a thermomobile dye is, for example, a dye which can be transferred from a thermal transfer dye providing material to a thermal transfer image receiving material by sublimation or diffusion in a medium.

However, thermal transfer image receiving materials for use in thermomobile type thermal transfer recording methods have the following disadvantages.

When the thermal transfer dye providing material and the thermal transfer image receiving material are superimposed upon each other and heat is applied thereto to transfer a thermomobile dye from the thermal transfer dye providing material to the image receiving material, both materials are thermally fused to each other. As a result, there is the possibility that the dye providing layer of the dye providing material is peeled off and sticks to the surface (to be transferred) of the image receiving material, or sometimes there may be a problem in that the image receiving material can no longer be conveyed and the printer is stopped. This problem is caused remarkably when applied voltage is elevated and thermal transfer is carried out at elevated temperatures to obtain sufficient transfer density.

Image receiving materials generally are stacked, before use, on top of each other in the form of several tens of sheets, and are fed one by one during the course of thermal transfer recording to thereby carry out printing. However, when slipperiness between image receiving materials is insufficient, a problem exists in that many sheets of the materials are fed at one time. The surfaces of the image receiving materials are charged with electricity under low humidity conditions in particular, and the faces and the backs of the image receiving materials are pulled by each other by static electricity, so that many sheets of the materials are liable to be fed at one time.

Further, there is the problem that when the image receiving materials are piled up after thermal transfer, the transferred dye is re-transferred to other image receiving materials to cause staining, that is, to cause color migration by re-transfer.

Furthermore, there is the problem that when the thermal transfer image receiving materials after transfer are stored over a long period of time, the image is liable to be faded.

SUMMARY OF THE INVENTION

An object of the present invention is to provide a thermal transfer image receiving material which is improved in feedability and conveyability, and has improved properties with regard to the problems of the heat fusion of a thermal transfer dye providing material during transfer the color migration by the re-transfer of dye after transfer and the fading of the image after storing over a ling period of time.

This object which will become apparent is accomplished by providing a thermal transfer image receiving material according to the present invention, which comprises a support having thereon at least one image receiving layer which can accept a dye to form an image, the dye migrating from a thermal transfer dye providing material when heated, wherein the material contains at least one layer on the image receiving layer-side of the support which contains fine solid particles of a fluorine compound and silicone oil.

DETAILED DESCRIPTION OF THE INVENTION

Now, the present invention will be illustrated in more detail below.

Fluorine compounds which are used in the present invention may be low-molecular weight compounds or high-molecular weight compounds. Examples of the low-molecular weight fluorine compounds include those described in U.S. Pat. Nos. 3,775,126, 3,589,906, 3,798,265, 3,779,768 and 4,407,937, West German Patent 1,293,189, U.K. Patent 1,259,398, JP-A-48-87826 (the term "JP-A" as used herein means an "unexamined published Japanese patent application"), JP-A-49-10722, JP-A-49-46733, JP-A-50-16525, JP-A-50-113221, JP-A-50-161236, JP-A-50-99525, JP-A-50-160034, JP A-51-43131, JP-A-51-106419, JP-A-51-7917, JP-A-51-32322, JP-A-51-151125, JP-A-51-151126, JP-A-51-151127, JP-A-51-129229, JP-A-52-127974, JP-A-52-80023, JP-A-53-84712, JP-A-53-146622, JP-A-54-14224, JP-A-54-48520, JP-A-55-7762, JP-A-56-55942, JP-A-56-114944, JP-A-56-114945, JP-B-57-8456 (the term "JP-B" as used herein means an "examined Japanese patent publication"), JP-B-57-12130, JP-B-57-12135 and JP-B-58-9408.

Examples of the high-molecular weight fluorine compounds include those described in U.S. Pat. Nos.

4,175,969, 4,087,394, 4,016,125, 3,676,123, 3,679,411 and 4,304,852, JP-A-52-129520, JP-A-54-158222, JP-A-55-57842, JP-A-57-11342, JP-A-57-19735, JP-A-57-179837, *The Elements of Chemistry, No. 27, New Fluorine Chemistry* (edited by Nippon Kagaku Kai, 1980) and *Functional Fluorine-Containing High-Molecular Material* (edited by Nikkan Kogyo Shinbun Sha, 1982).

These fluorine compounds can be prepared by the methods described in these patent specifications and the literature. Generally, these compounds can be prepared by fluorinating the corresponding hydrocarbons. The fluorination of hydrocarbons are described in more detail in *New Experimental Chemical Lecture,* Vol. 14[I], pages 308 to 331, published by Maruzen (1977).

Fine solid particles of fluorine compounds (hereinafter referred to as fluorinated fine solid particles) which are used in the present invention are fine powders of the above-described fluorine compounds and have a particle diameter of preferably 0.01 to 30 μm, more preferably 0.1 to 10 μm.

Preferred examples of the fluorinated fine solid particles which are used in the present invention include fine particles of a tetrafluoroethylene resin, a tetrafluoroethylene telomer, a tetrafluoroethylene-hexafluoropropylene copolymer, a polyvinylidene fluoride and a trifluorinated ethylene chloride resin.

These fine powders are commercially available in the form of an organic solvent dispersion or an aqueous dispersion. For example, the following products are commercially available.

| | | |
|---|---|---|
| Products of Mitsui du Pont Fluorochemical KK. | | |
| Teflon ® | 6-J | (fine powder) |
| " | 60-J | (fine powder) |
| " | 62-J | (fine powder) |
| " | 30-J | (aqueous dispersion) |
| " | 120-J | (aqueous dispersion) |
| Products of E. I. dupont de Nemours & Co., Inc. | | |
| Vydax ® | 1000 | (organic solvent dispersion) |
| " | AR | (organic solvent dispersion) |
| " | WD | (aqueous dispersion) |
| Products of Daikin Kogyo Co., Inc. | | |
| Polyflon ® | TFE | (organic solvent dispersion) |
| Neoflon ® | FEP | (organic solvent dispersion) |
| Neoflon ® | VDF | (fine powder) |
| Neoflon ® | CTFE | (organic solvent dispersion) |
| Rublon ® | L-5 | (powder) |
| " | L-2 | (powder) |
| " | LD-1 | (organic solvent dispersion) |

The fluorinated fine solid particles which are used in the present invention are added to coating solutions for forming a layer on the image receiving layer-side of the support in the following manner.

[I] Coating solutions comprising organic solvents (1) Powdered fluorinated fine solid particles are dispersed in the same organic solvent as that used in the coating solution, or are dispersed in a solution of a polymer (which acts as a binder) dissolved in the organic solvent, and the resulting dispersion is added to a coating solution.

(2) When the fluorinated fine solid particles are obtained in the form of a dispersion thereof in an organic solvent, an appropriate amount of the dispersion as such is added to a coating solution. [II] Aqueous coating solutions (1) Powdered fluorinated fine solid particles are dispersed in water or an aqueous solution of a water soluble polymer and the resulting dispersion is added to an aqueous coating solution.

(2) When the fluorinated fine solid particles are obtained in the form of a dispersion thereof in an organic solvent, the dispersion is emulsified and dispersed in water or an aqueous solution of a water-soluble polymer and the resulting emulsified dispersion is added to an aqueous coating solution.

Surfactants (particularly preferably fluorine containing surfactants) can be used as a dispersion aid when the fluorinated fine solid particles are dispersed. Preferred organic solvents are fluorine-containing organic solvents.

In the present invention, the fluorinated fine solid particles are used in an amount of preferably 0.001 to 5 g/m$^2$, more preferably 0.005 to 1 g/m$^2$, particularly preferably 0.01 to 0.5 g/m$^2$.

The fluorinated fine solid particles may be added to any of the layers of the image receiving material, but the particles are preferably added to the outermost layer.

Unmodified silicone oil, as well as modified silcone oil, such as, carboxy-modified silicone oil, amino modified silicone oil, epoxy-modified silicone oil, polyether-modified silicone oil and alkyl-modified silicone oil, can be used as the silicone oil which is employed in the present invention. Examples of modified silicone oil include those described in *Modified Silicone Oil* in technical materials, page 6 to 18B, published by Shinetsu Silicone KK, (Mar. 3, 1987).

Examples of the modified silicone oil include those having the following skeleton structures and the following compounds, wherein x, y, z, m and n each is an integer of 1 or more.

(1) Epoxy-modified silicone oil

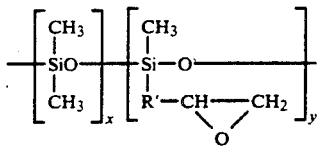

R': bonding group such as $-(CH_2)_n-$, particularly $-CH_2-$ (The group R' appears in other structures set forth below and has the same meaning as in the present structure (1).)

For example,

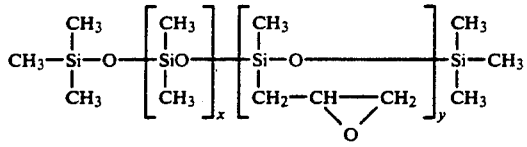

(2) Alkyl-modified silicone oil

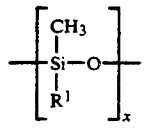

$R^1$: alkyl or alkyl/aralkyl

For example,

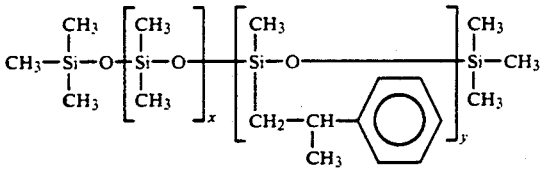

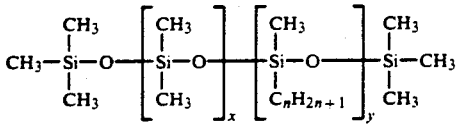

(3) Polyether-modified silicone oil

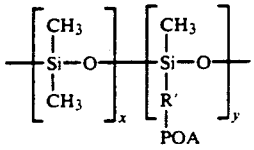

POA: polyoxyalkylene group such as oxyethylene/oxypropylene (The term "POA" is used below in other structures and has the same meaning as in the present structure (3).)

For example,

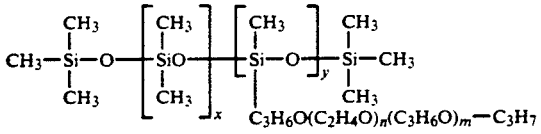

(4) Alcohol-modified silicone oil

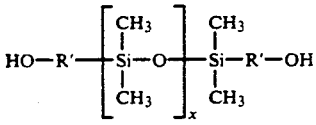

or

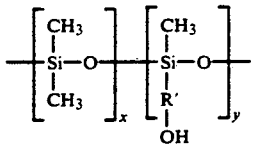

(5) Amino-modified silicone oil

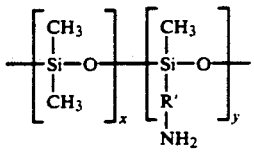

For example,

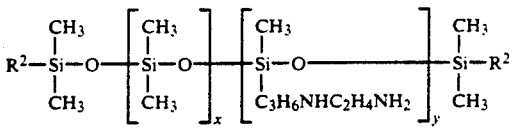

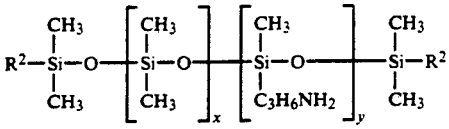

$R^2$: $CH_3$ or $OCH_3$ (6) Carboxyl-modified silicone oil

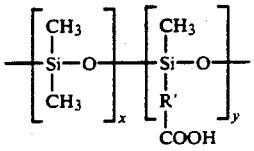

For example,

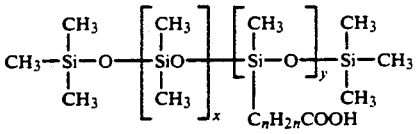

(7) Fluorine-modified silicone oil

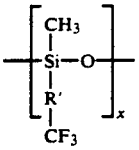

(8) Higher fatty acid-modified silicone oil

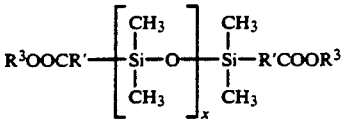

$R^3$: aliphatic hydrocarbon group (9) Epoxy-polyether-modified silicone oil

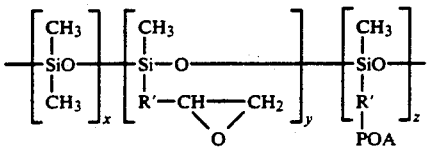

(10) Alkyl-polyether-modified silicone oil

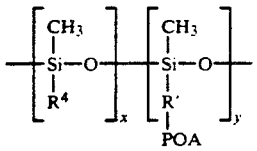

$R^4$: alkyl group

These silicone oils may be used either alone or in a combination with two or more of them.

Unmodified silicone oil or modified silicone oil which are used in the present invention are used in an amount of 0.1 to 50% by weight, preferably 1 to 40% by weight, particularly preferably 2 to 30% by weight, based on the combined amount of the dye accepting polymer and the water-soluble binder contained in the layer to which the silicone compounds are added.

Unmodified silicone oil or modified silicone oil are added to coating solutions in the following manner.

[I] Coating solutions comprising organic solvents

A predetermined amount of silicone oil as such is added to a coating solution and the mixture is stirred to make it uniform.

[II] Aqueous coating solutions (1) Silicone oil as such is emulsified and dispersed in water or an aqueous solution of a hydrophilic polymer, or silicone oil is diluted with a water-incompatible organic solvent and then emulsified and dispersed in water or an aqueous solution of a hydrophilic polymer. The resulting emulsified dispersion is added to an aqueous coating solution.

(2) When an organic solvent solution of a dye accepting polymer is emulsified and dispersed in an aqueous solution of a hydrophilic polymer, silicone oil is dissolved in the solution of the dye accepting polymer and the resulting solution is emulsified and dispersed in the aqueous solution of the hydrophilic polymer. The resulting emulsified dispersion is added to an aqueous coating solution.

(3) When silicone oil is soluble in water or a water-miscible organic solvent (e.g., methanol, ethanol, acetone), silicone oil is dissolved in the solvent and the solution is added to an aqueous coating solution, or silicone oil is directly added to an aqueous coating solution.

Among the manners for adding silicone oil to the aqueous coating solution, the manners (1) and (2) as described above are preferred and the manner (2) is particularly preferred.

Any materials can be used as a support for the thermal transfer image receiving material of the present invention, so long as it can withstand the transfer temperature and can meet requirements with respect to smoothness, whiteness, slipperiness, friction properties, antistatic properties and recess after transfer. Examples of such supports include paper supports such as synthetic paper (e.g., polyolefin or polystyrene-based synthetic paper), the best quality paper, art paper, coated paper, cast coated paper, wall paper, lining paper, paper impregnated with synthetic resin or emulsion, synthetic rubber latex-impregnated paper, paper containing synthetic resin internally added, cardboard, cellulose fiber paper and polyolefin-coated paper (particularly paper wherein both sides thereof are coated with polyethylene); various plastic films or sheets made of polyolefins, polyvinyl chloride, polyethylene terephthalate, polystyrene, methacrylates and polycarbonates, and films or sheets obtained by making these plastics white color-reflective; and laminates of any combinations of the above materials.

Among these supports, polyolefin-coated paper obtained by laminating a film onto both sides of paper support are preferred, because an image of good quality can be obtained and they are excellent in aptitude of glossing treatment, whiteness and anti-curling properties. Polyethylene-coated paper obtained by laminating polyethylene film is particularly preferred.

However, these polyolefin-coated paper have problems in that the above-mentioned feedability and conveyability are poor, failure in feeding and conveying is caused, the coated paper and the dye providing material are thermally fused to each other during thermal transfer, color migration by re-transfer is caused and the image is liable to fade. These problems can be solved for the first time by the present invention. Namely, it became possible that the coefficient of friction on the surface of the image receiving layer can be lowered, and the surface of the image receiving layer is scarcely charged with electricity and the thermal transfer image receiving material and the thermal transfer dye providing material are hardly fused when fine solid particles of the fluorine-containing compound are used in combination with silicone oil, and the combination is incorporated in at least one layer (preferably the outermost layer) on the image receiving layer-side of the thermal transfer image receiving material.

The fluorinated fine solid particles alone or the silicone oil alone are known as antistatic agents. However, when the fluorinated fine solid particles alone are used, feedability, conveyability and the problem of heat fusion are slightly improved, but the level of improvement is insufficient. When the amount thereof is increased, the particles have adverse effects in that surface properties are deteriorated, unevenness in transfer is caused, gloss is reduced and feedability can not be sufficiently improved. Further, when the silicone oil alone is used, the problems of feedability and conveyability can be somewhat solved, but the level of improvement is insufficient. When the amount thereof is increased, the oil has such adverse effects that the image is faded, color migration by re-transfer grows serious and feedability can not be sufficiently improved. Namely, the above-described problem with respect to feedability can not be solved when the fluorinated solid particles alone are used or when the silicone oil alone is used. When the amounts thereof are increased, the above-described problem with respect to feedability can not be solved and a disadvantage exists in that other problems are more and more serious. It is a surprising finding that feedability can be remarkably improved and at the same time other problems can be solved when the fluorinated fine solid particles and the silicone oil are used in combination according to the present invention.

The thermal transfer image receiving material is provided with an image receiving layer. The image receiving layer contains a substance capable of accepting the thermomobile dye which substance has functions capable of receiving the thermomobile dye migrating from the thermal transfer dye providing material during printing and fixing the thermomobile dye, optionally in combination with another binder substance. The image receiving layer is a layer of preferably 0.5 to 50 μm in thickness. The substance which accepts the thermomobile dyes is typically a polymer. Examples of these substances include the following resins.

(a) Resins having an ester linkage

Polyester resins obtained by condensing a dicarboxylic acid component (the dicarboxylic component may be substituted by a sulfo group or a carboxyl group) such as terephthalic acid, isophthalic acid or succinic acid with ethylene glycol, diethylene glycol, propylene glycol, neopentyl glycol or bisphenol A; polyacrylate resins and polymethacrylate resins such as polymethyl methacrylate, polybutyl methacrylate, polymethyl acrylate and polybutyl acrylate; polycarbonate resins; polyvinyl acetate resins; styrene-acrylate resins; and vinyltoluene acrylate resins. Examples of these resins are described in JP-A-59-101395, JP-A-63-7971, JP-A-63-7972, JP-A-63-7973 and JP-A-60-294862. Examples of resins which are commercially available include Vylon 290, Vylon 200, Vylon 280, Vylon 300, Vylon 103, Vylon GK-140 and Vylon GK-130 (products of Toyobo Co., Ltd.), ATR-2009 and ATR-2010 (products of Kao Corporation), Pruscoat Z-466, Pruscoat Z-448, Pruscoat Z-455, Pruscoat Z-461, Pruscoat Z-767 and Pruscoat Z 771 (products of Goo Kagaku K. K.) Pesresin A-1243, Pesresin A-2141 and Pesresin A-2151 (products of Takamatsu Yushi K. K.), and Finetex ES-611, Finetex ES-650, Finetex ES-670, Finetex ES-675 and Finetex ES-850 (product of Dainippon Ink and Chemicals, Inc.).

(b) Resins having a urethane linkage

Urethane resins (c) Resins having an amido linkage

Polyamide resins (d) Resins having a urea linkage

Urea resins (e) Resins having a sulfone linkage

Polysulfone resins (f) Other resins having a high polar linkage

Polycaprolactone resins, styrene-maleic anhydride resin, polyvinyl chloride resin, polyacrylonitrile resin.

In addition thereto, mixtures of these resins and copolymers of these resins can be used.

The thermal transfer image receiving material, particularly the image receiving layer may contain high-boiling organic solvents or thermal solvents as substances capable of accepting the thermomobile dyes or as dye-diffusing aids.

Examples of the high-boiling organic solvents and the thermal solvents include compounds described in JP-A-62-174754, JP-A-62-245253, JP-A-61-209444, JP-A-61-200538, JP-A-62-8145, JP-A-62-9348, JP-A-62-30247 and JP-A-62-136646.

The image receiving layer of the thermal transfer image receiving material of the present invention may have such a structure that (1) the layer containing the substance alone which accepts the thermomobile dye is provided on the support, or (2) the layer containing the substance which accepts the thermomobile dye, with the substance being dispersed in the water-soluble binder, is provided on the support. Conventional water-soluble polymers can be used as the water-soluble binders in case (2). However, water-soluble polymers having a group capable of crosslinking with hardening agents are preferred.

In the above-described case (1), the polymers used in the receiving layer for the thermomobile dye are soluble in organic solvents and so an organic solvent system is used for the receiving layer coating solution. Furthermore, the apparatus and vessels used in the manufacturing process must be cleaned with organic solvents. Hence, the apparatus used for preparing the coating solution and the coating apparatus must be explosion-proof. Furthermore, organic solvents are very expensive when compared to water and so the production costs are increased. Moreover, problems can arise with the health supervision of the operators. Polymers which soften or become rubber-like during thermal transfer are sometimes used as binders for receiving layers, or plasticizers may be used, in order to achieve high density images. However, irregularities are produced at the transfer surface in the maximum density regions when these devices are used and this results in a loss of gloss. Moreover, the image tends to fade on the long term storage of the thermal transfer image receiving material after a transfer has been made.

In the above-described case (2), the dye accepting substance is not coated as an organic solvent solution, but is coated as a dispersion of the dye accepting substance in the water-soluble binder, unlike case (1). Water can be used as the solvent for the coating solution. Therefore, there is no risk of an explosion, the manufacturing costs can be markedly reduced and adverse effects on operator health are greatly reduced. There are advantages in that the layer containing the dye accepting substance dispersed in the water-soluble binder can sufficiently accept the thermomobile dye to thereby give an image having a high transfer density and the resulting image is scarcely faded, even when stored over a long period of time.

Accordingly, it is preferred that the image receiving layer of the present invention has such a structure that the substance capable of accepting the thermomobile dye is dispersed in the water-soluble binder as in the case (2).

Examples of the water-soluble polymers which can be used in the present invention include vinyl polymers and derivatives such as polyvinyl alcohol, polyvinyl pyridinium and cation-modified polyvinyl alcohol (see, JP-A-60-145879, JP-A-60-220750, JP-A-61-143177, JP-A-61-235182, JP-A-61-245183, JP-A-61-237681 and JP-A-61-261089); polymers having an acryloyl or methacryloyl group such as polyacrylamide, polydimethylacrylamide, polydimethylaminoacrylate, polyacrylic acid and salts thereof, acrylic acid-methacrylic acid copolymer and salts thereof, polymethacrylic acid and salts thereof and acrylic acid-vinyl alcohol copolymers and salts thereof (see, JP-A-60-168651, JP-A-62-9988); natural polymers and derivatives such as starch, oxidized starch, starch acetate, amine starch, carboxylated starch, dialdehyde starch, cationic starch, dextrin, sodium alginate, gelatin, gum arabic, casein, pullulan, dextran, methyl cellulose, ethyl cellulose, carboxymethyl cellulose and hydroxypropyl cellulose (see, JP-A-59-174382, JP-A-60-262685, JP-A-61-143177, JP-A-61-181679, JP-A-61-193879 and JP-A-61-287782); synthetic polymers such as polyethylene glycol, polypropylene glycol, polyvinyl methyl ether, maleic acid-vinyl acetate copolymers, maleic acid-N-vinylpyrrolidone copolymers, maleic acid-alkyl vinyl ether copolymers and polyethyleneimine (see, JP-A-61-32787, JP-A-61-237680 and JP-A-61-277483); and water-soluble polymers described in JP-A-56-58869.

Further, various copolymers which are made water-soluble by using monomer components having a $SO_3^-$ water group, a $COO^-$ group or a $SO_2^-$ group can also be used.

It is particularly preferred to use gelatin as the water-soluble binder, because set drying can be carried out and the drying load is very low. Examples of gelatin which can be used in the present invention include gelatin and derivatives thereof such as lime-processed gelatin, lime-processed gelatin which has been subjected to a calcium removal treatment, acid-processed gelatin, phthalated gelatin, acetylated gelatin and succinated gelatin; and enzyme-processed gelatin, gelatin hydrolyzate and enzymatic decomposate of gelatin described in *Bull. Soc. Phot. Japan, No.* 16, p. 30 (1966).

These water-soluble polymers may be used either alone or in a combination of two or more.

The water-soluble binder and the substance capable of accepting the thermomobile dye are used in a ratio by weight of the substance capable of accepting the thermomobile dye/the water-soluble binder of 1 to 20, preferably 2 to 10, particularly preferably 3 to 7.

The substances capable of accepting the thermomobile dye can be dispersed in the water-soluble binders by any of the conventional dispersion methods for dispersing hydrophobic substances in water-soluble polymers. Typical methods thereof include a method wherein a solution of the substance capable of accepting the thermomobile dye in a water-immiscible organic solvent is emulsified and dispersed in an aqueous solution of the water-soluble binder, and a method wherein a latex of the substance capable of accepting the thermomobile dye (e.g., a polymer) is mixed with an aqueous solution of the water-soluble binder.

The image receiving layer may be composed of two or more layers. In this case, synthetic resins having a low glass transition point and a high-boiling organic solvent or a thermal solvent are used for the layer nearer to the support to increase the dyeing affinity of the dye. Synthetic resins having a higher glass transition point and optionally the irreducible minimum amount of the high-boiling organic solvent or the thermal solvent are used for the outermost layer so that the sticking of the surface, adherence to other materials, re-transfer to other materials after transfer and heat fusion to the thermal transfer dye providing material can be prevented.

The thickness of the image receiving layer is generally from 0.5 to 50 μm, preferably 3 to 30 μm in total. When it is composed of two layers, the outermost layer has a thickness of 0.1 to 2 μm, preferably 0.2 to 1 μm.

The thermal transfer image receiving material of the present invention may have an interlayer between the support and the image receiving layer.

The interlayer is a layer having a function as a cushioning layer, a porous layer or a layer for preventing the dye from diffusing, or is a layer having two or more of these functions, depending on the materials constituting the interlayer. The interlayer sometimes serves as an adhesive.

The layer for preventing the dye from diffusing plays a role in preventing the thermomobile dye in particular from diffusing in the support. Water-soluble or organic solvent-soluble binders can be used for the layer for preventing the diffusion, but water-soluble binders are preferred. Examples of the binders include the above-described water-soluble binders for the image receiving layer. Gelatin is particularly preferred.

The porous layer plays a role in preventing applied heat during thermal transfer from diffusing from the image receiving layer into the support to effectively utilize the applied heat.

The image receiving layer, the cushioning layer, the porous layer, the diffusion inhibiting layer, the adhesive layer, the back layer, etc. which constitute the thermal transfer image receiving material of the present invention may contain fine powders of silica, clay, talc, diatomaceous earth, calcium carbonate, calcium sulfate, barium sulfate, aluminum silicate, synthetic zeolite, zinc oxide, lithopone, titanium oxide and alumina.

The thermal transfer image receiving materials may contain brightening agents. Examples of the brightening agents include compounds described in K. Veenkataraman, *The Chemistry of Synthetic Dyes,* Vol. 5, Chapter 8 and JP-A-61-143752. Suitable brightening agents include stilbene compounds, coumarin compounds, biphenyl compounds, benzoxazolyl compounds, naphthalimide compounds, pyrazoline compounds, carbostyril compounds and 2,5-dibenzoxazolylthiophene compounds.

The brightening agents may be used in combination with anti-fading agents.

The preferred embodiments of the present invention include (1) a thermal transfer image receiving material comprising a support having thereon at least one image receiving layer which can accept a dye to form an image, the dye migrating from a thermal transfer dye providing material when heated, wherein the image receiving layer is formed by comprising coating a dispersion and drying a coated layer, the dispersion being formed by comprising dissolving a substance capable of accepting the dye and silicone oil in a water-incompatible organic solvent, emulsifying and dispersing the solution in an aqueous solution of a water-soluble binder and adding a dispersion of fine solid particles of a fluorine compound to the emulsified dispersion, and (2) a thermal transfer image receiving material comprising a support having thereon at least one image receiving layer which can accept a dye to form an image, the dye migrating from a thermal transfer dye providing material when heated, wherein the image receiving layer is formed by comprising coating a dispersion and drying a coated layer, the dispersion being formed by comprising emulsifying and dispersing a solution of silicone oil in an organic solvent in a mixture of a latex of a substance capable of accepting the dye or an aqueous solution of a water-soluble substance capable of accepting the dye and an aqueous solution of a water-soluble binder and adding a dispersion of fine solid particles of a fluorine compound to the emulsified dispersion.

When a dispersion for the image receiving layer is coated, such a problem that the dispersion is repelled to become an uneven coating is liable to occur immediately after coated. Accordingly, it is preferred that a dispersion for at least the outermost layer of the image receiving layer further comprises a fluorine containing surfactant as a coating aid. Examples of the fluorine containing surfactants include those as described in JP-B-57-9053, columns 8 et seq. and JP-A-61 20944, and particularly preferred examples thereof include anionic organic fluorine containing surfactants.

The thermal transfer dye providing material is a material comprising a support having thereon a layer containing the thermomobile dye. Heat is applied to the material to thereby allow the dye in the form of a pattern corresponding to the heat pattern which has been applied to migrate to the image receiving layer of the thermal transfer image receiving material.

Any of the conventional supports can be used as the supports of the thermal transfer dye providing materials. Examples of the supports include polyethylene terephthalate, polyamides, polycarbonates, glassine paper, condenser paper, cellulose esters, fluoropolymers, polyethers, polyacetals, polyolefins, polyimides, polyphenylene sulfide, polypropylene, polysulfone and cellophane.

The support has a thickness of generally 2 to 30 μm and may optionally have a subbing layer (undercoat layer). If desired, a layer composed of a hydrophilic polymer for preventing the dye from diffusing may be provided between the support and the dye providing layer, whereby transfer density can be further improved. The above-described water-soluble polymers can be used as hydrophilic polymers for the layer.

There may be provided a slipping layer to prevent the thermal head from sticking to the dye providing material. The slipping layer comprises a lubricant with or without a polymer binder, such as a surfactant, a solid or liquid lubricant or a mixture thereof.

If desired, two or more dye providing layers containing different dyes may be arranged on one thermal transfer dye providing material by choosing dyes so as to allow the desired hues to be transferred when printed. For example, when the printing of each color according to chrominance signals is repeatedly made to form an image as in a color photograph, it is desirable that the printed hue be for each of the cyan, magenta and yellow colors. In this case, three dye providing layers containing dyes giving such hues are arranged. If desired, a dye providing layer containing a dye giving a black hue may be provided in addition to the layer giving cyan, magenta and yellow colors. It is preferred that when these dye providing layers are formed, a mark for position detection is made simultaneously with the formation of any one of the dye providing layers, because an extra inking or printing stage is not required in addition to the formation of the dye providing layers. The thermal transfer dye providing material using the thermomobile dye comprises a support having thereon a thermal transfer layer containing a binder and a dye which is made mobile or sublimes by heat. The thermal transfer dye providing material can be prepared in the following manner. A conventional dye which is made mobile or sublimes by heat and a binder resin are dissolved or dispersed in an appropriate solvent to prepare a coating solution. One side of the conventional support for the thermal transfer dye providing material is coated with the coating solution in such an amount as to give a dry film of about 0.2 to 5 μm, preferably 0.4 to 2 μm in thickness to form a thermal transfer layer.

Any of the dyes which are used for conventional thermal transfer dye providing materials can be used as dyes for use in the formation of the thermal transfer layers of the present invention. Dyes having a low molecular weight of about 150 to 800 are preferably used in the present invention. Dyes are chosen by taking transfer temperature, hue, light resistance and solubility or dispersibility in ink and binder resins into consideration.

Examples of the dyes include disperse dyes, basic dyes and oil-soluble dyes. More specifically, examples of suitable dyes include Sumikaron Yellow E4GL, Dianix Yellow H2G-FS, Miketon Polyester Yellow 3GSL, Kayazet Yellow 937, Sumikaron Red EFBL, Dianix Red ACE, Miketon Polyester Red FB, Kayazet 126, Miketon Fast Brilliant Blue B and Kayazet Blue 136. Other conventional thermomobile dyes can also be used.

Any of the conventional binder resins can be used as binder resins used together with the dyes in the present invention. Generally, dyes are chosen from among those which have high resistance to heat and do not interfere with the migration of the dyes when heated. Examples of such binder resins include polyamide resins, polyester resins, epoxy resins, polyurethane resins, polyacrylic resins (e.g., polymethyl methacrylate, polyacrylamide, polystyrene-2-acrylonitrile), polyvinyl pyrrolidone, polyvinyl chloride resin (e.g., vinyl chloride-vinyl acetate copolymer), polycarbonate resins, polystyrene, polyphenylene oxide, cellulose resins (e.g., methyl cellulose, ethyl cellulose, carboxymethyl cellulose, cellulose acetate hydrogenphthalate, cellulose acetate, cellulose acetate propionate, cellulose acetate butyrate, cellulose triacetate), polyvinyl alcohol resins (e.g., polyvinyl alcohol, partially saponified polyvinyl alcohol such as polyvinyl butyral), petroleum resins, rosin derivatives, cumarone-indene resin, terpene resins and polyolefin resins (e.g., polyethylene, polypropylene).

The binder resins are used in an amount of preferably about 80 to 600 parts by weight per 100 parts by weight of the dye.

Any of the conventional ink solvents can be used as ink solvents for use in dissolving or dispersing the above-described dyes and binder resins.

Release agents may be incorporated in the layers of the dye providing materials and/or the image receiving material to improve release properties between the thermal transfer dye providing material and the thermal transfer image receiving material. It is particularly preferred that the release agents are incorporated in the outermost layers where both materials are brought into contact with each other.

Conventional release agents can be used. Examples of the release agents include waxy substances such as polyethylene wax and amide wax; surfactants such as fluorinated compounds and phosphoric esters; and oil such as paraffinic oil and fluorinated oil.

The layers of the thermal transfer dye providing material and the thermal transfer image receiving material of the present invention may be hardened by using hardening agents.

Hardening agents described in JP-A-61-199997 and JP-A-58-215398 can be used when organic solvent-soluble polymers are to be hardened. For example, isocyanate hardening agents can be preferably used for polyester resins.

Hardening agents described in U.S. Pat. No. 4,678,739 (41st column), JP-A-59-116655, JP-A-62-245261 and JP-A-61-18942 can be used when water-soluble polymers are to be hardened.

More specifically, examples of the hardening agents include aldehyde hardening agents (e.g., formaldehyde), aziridine hardening agents, epoxy hardening agents (e.g.,

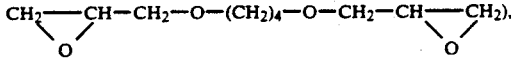

vinyl sulfone hardening agents (e.g., N,N'-ethylene-bis(-vinylsulfonylacetamido)ethane), N-methylol hardening agents (e.g., dimethylolurea), and high-molecular weight hardening agents (e.g., compounds described in JP-A-62-234157).

The thermal transfer dye providing material and the thermal transfer image receiving material may contain anti-fading agents. Examples of the anti-fading agents include antioxidants, ultraviolet light absorbers and various metal complexes.

Examples of the antioxidants include chroman compounds, coumaran compounds, phenol compounds (e.g., hindered phenols), hydroquinone derivatives, hindered amine derivatives and spiro-indane compounds. Further, compounds described in JP-A-61-159644 can be effectively used.

Examples of the ultraviolet light absorbers include benztriazole compounds (e.g., those described in U.S. Pat. No. 3,533,794), 4-thiazolidone compounds (e.g., those described in U.S. Pat. No. 3,352,681), benzophenone compounds (e.g., those described in JP-A-56-2784) and compounds described in JP-A-54-48535, JP-A-62-136641 and JP-A-61-88256. Further, ultraviolet light absorbing polymers described in JP-A-62-260152 can be effectively used.

Examples of the metal complexes include compounds described in U.S. Pat. Nos. 4,241,155, 4,245,018 (3rd to 36th columns), and 4,254,195 (3rd to 8th columns), JP-A-62 174741, JP-A-61-88256 (pages 27 to 29), Japanese Patent Application Nos. 62-234103, and 62-31096 (corresponding to JP-A-1-75568 and JP-A-63-199248, respectively).

Examples of useful anti-fading agents are described in JP-A-62-215272 (pages 125 to 137).

The anti-fading agents may be previously incorporated in the image receiving material to prevent the dye transferred to the image receiving material from being faded. Alternatively, the anti-fading agents may be fed to the image receiving material from external sources. For example, the anti-fading agents may be transferred from the dye providing material to the image receiving material.

The above-mentioned antioxidants, ultraviolet light absorbers and metal complexes may be used in combinations.

The layers of the thermal transfer dye providing material and the thermal transfer image receiving material may contain various surfactants as a coating aid or for the purpose of improving release properties and slipperiness or imparting antistatic properties.

Examples of the surfactants include nonionic surfactants, anionic surfactants, amphoteric surfactants and cationic surfactants. Specific examples of these surfactants are described in JP-A-62-173463 and JP-A-62-183457.

It is preferred that the surfactants are used as a dispersion aid when the substance capable of accepting the thermomobile dye, the release agent, the anti-fading agent, the ultraviolet light absorber, the brightening agent and other hydrophobic compounds are dispersed in the water-soluble binder. For this purpose, surfactants described in JP-A-59-157636 (pages 37 to 38) in addition with the above-described surfactants are particularly preferred.

The layers of the thermal transfer dye providing material and the thermal transfer image receiving material may contain organofluoro compounds for the purpose of improving slipperiness and release properties or imparting antistatic properties. Typical examples of the organofluoro compounds include fluorine-containing surfactants or oily fluorine-containing compounds such as fluorine containing oil as described in JP-B-57-9053 (8th to 17th column), JP-A-61-20944 and JP-A-62-135826.

The thermal transfer dye providing material and the thermal transfer image receiving material may contain matting agents. Examples of the matting agents include silicon dioxide compounds such as polyolefins or polymethacrylates described in JP A-61-88256 (page 29), and compounds such as benzoguanamine resin beads, polycarbonate resin beads and polystyrene resin beads described in JP-A-63-274944 and JP-A-63-274952.

It is preferred that the side (on which the dye providing layer is not provided) of the support is subjected to an anti-sticking treatment to prevent sticking from being caused by the heat of the thermal head when printing is made from the back of the dye providing material and to improve slipperiness.

For example, it is preferred to provide a heat-resisting slip layer mainly composed of (1) a reaction product of a polyvinyl butyral resin with an isocyanate, (2) an alkali metal or alkaline earth metal salt of a phosphoric ester and (3) a filler. Polyvinyl butyral resins having a molecular weight of about 60,000 to 200,000 and a glass transition point of 80° to 110° C. are used. Polyvinyl butyral resins having a vinyl butyral moiety content of 15 to 40% by weight are preferred, because many reaction sites exist with isocyanate. As the alkali metal or alkaline earth metal salt of a phosphoric ester, Gafac RD270 (a product of Toho Kagaku KK) can be used. The salt is used in an amount of 1 to 50% by weight, preferably 10 to 40% by weight, based on the amount of the polyvinyl butyral resin.

It is desirable to provide a heat-resistant layer under the heat-resisting slip layer. Such a layer can be formed by coating a combination of a synthetic resin capable of being cured by heat and a hardener thereof, for example, a combination of polyvinyl butyral and a polyisocyanate, a combination of an acrylic polyol and a polyisocyanate, a combination of cellulose acetate and a titanium chelating agent or a combination of a polyester and an organotitanium compound.

If desired, the dye providing material may be provided with a hydrophilic barrier layer to prevent the dye from diffusing in the direction of the support. The hydrophilic dye barrier layer contains useful hydrophilic substances. Generally, good results can be obtained by using gelatin, polyacrylamide, poly(isopropylacrylamide), butyl methacrylate-grafted gelatin, ethyl methacrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid or a mixture of cellulose monoacetate and polyacrylic acid. Among them, polyacrylic acid, cellulose monoacetate and polyvinyl alcohol are particularly preferred.

The dye providing material may have a subbing layer. Any subbing layer (undercoat layer) may be used, so long as the layer has the desired effect. Preferred examples of the compounds for use in the subbing layers include a copolymer of acrylonitrile-vinylidene chloride-acrylic acid (14:80:6 by weight), a copolymer of butyl acrylate-2-aminoethyl methacrylate-2-hydroxyethyl methacrylate (30:20:50 by weight), linear saturated polyesters such as Bostick 7650 (Amheart, Bostick Chemical Group) and chlorinated high-density poly-(ethylene-trichloroethylene). Though there is no particular limitation with regard to the coating weight of the subbing layer, the layer is generally used in an amount of 0.1 to 2.0 g/m$^2$.

In the present invention, the thermal transfer dye providing material and the thermal transfer image receiving material are superimposed upon each other. Heat energy according to the information on the image is applied to the laminate from either side, preferably from the back of the thermal transfer dye providing material, for example, by means of a heating device such as a thermal head to thereby transfer the dye in the dye providing layer according to the intensity of the heating energy to the thermal transfer image receiving material. In this way, a color image having excellent clarity and resolving gradation can be obtained.

Conventional heating means such as a laser beam (e.g., semiconductor laser beam), an infrared flash and a hot pen can be used in addition to the thermal head.

The combination of the thermal dye providing dye material with the thermal image receiving material according to the present invention can be used in the fields of printing by thermal printing type printers, facsimiles, the preparation of the prints of images by magnetic recording systems, magneto optical recording systems and optical recording systems and the preparation of prints from televisions and CRT screens.

Thermal transfer recording systems are fully described in JP-A-60-34895.

The present invention is now illustrated in greater detail by reference to the following examples which, however, are not to be construed as limiting the invention in any way.

Unless otherwise indicated, all percents, ratios, parts, etc. are by weight.

EXAMPLE 1

Preparation of thermal transfer dye providing material (A)

A polyethylene terephthalate film (Lumirror, a product of Toray Industries, Inc.) of 4.5 μm in thickness, which has a heat-resisting slip layer consisting of a thermosetting acrylic resin on one side thereof, was used as a support. The side opposite to the heat-resisting slip layer-side of the support was coated with the following coating composition (A) for the formation of a thermal transfer dye providing layer by means of wire bar coating in such an amount as to give a dry film of 2 μm in thickness. A slipping layer comprising polyvinyl butyral (Butbar 76, a product of Monsanto) (0.45 g/m$^2$) and poly(vinyl stearate) (0.3 g/m$^2$) was formed on the back of the support by coating the back with a tetrahydrofuran solution, thus obtaining a thermal transfer dye providing material (A).

| Coating composition (A) for the formation of thermal transfer dye providing layer | |
|---|---|
| Disperse dye (2,3-diphenoxyanthraquinone) | 4 g |
| Polyvinyl butyral resin (Denka Butyral 5000-A, a product of Denki Kagaku) | 4 g |
| Methyl ethyl ketone | 40 ml |
| Toluene | 40 ml |
| Polyisocyanate (Takenate D110N, a product of Takada Chemical Industries, Inc.) | 0.2 ml |

-continued

| Preparation of dye accepting polymer emulsion A | |
|---|---|
| Composition of Solution I | |
| Gelatin (10 wt % aqueous solution) | 100 g |
| Sodium dodecylbenzenesulfonate (5 wt % aqueous solution) | 50 ml |
| Water | 50 ml |
| Composition of Solution II | |
| Polyester resin (Vylon 280, a product of Toyobo Co., Ltd.) | 30 g |
| Toluene | 60 g |
| Methyl ethyl ketone | 60 g |
| Thermal solvent (diphenyl phthalate) | 12 g |

The solution II was prepared and then added to the Solution I while stirring the Solution I. The mixture was emulsified and dispersed in a homogenizer at 15,000 rpm for 9 minutes to prepare a dye accepting polymer emulsion A.

Preparation of dye accepting polymer emulsion B

| | |
|---|---|
| Composition of Solution I | |
| Gelatin (10 wt % aqueous solution) | 100 g |
| Sodium dodecylbenzenesulfonate (5 wt % aqueous solution) | 50 ml |
| Water | 50 ml |
| Composition of Solution II | |
| Polyester resin (Vylon 280, a product of Toyobo Co., Ltd.) | 30 g |
| Toluene | 60 g |
| Methyl ethyl ketone | 60 g |
| Thermal solvent (diphenyl phthalate) | 9 g |
| Silicone oil (1)* | a g (See Table 1) |

After each of the Solutions I and II was thoroughly dissolved, the Solution II was added to the Solution I while stirring the Solution I. The mixture was emulsified and dispersed in a homogenizer at 15,000 rpm for 9 minutes to prepare a dye accepting polymer emulsion B.

In the above composition, silicon oil (1)* given in Table 1 was used.

Preparation of coating solution for thermal transfer image receiving material

| | |
|---|---|
| First layer | |
| Gelatin (10 wt % aqueous solution) | 100 g |
| Water | 40 ml |
| Hardening agent (4 wt % aqueous solution) [1,2-bis (vinylsulfonylacetamido) ethane] | 60 ml |
| Second layer | |
| Dye accepting polymer emulsion A | 100 g |
| Water | 50 ml |
| Third layer (outermost layer) | |
| Dye accepting polymer emulsion B | 100 g |
| Water | 50 ml |
| Fluorine-containing surfactant (1)* (5% solution) | 5 ml |
| Fluorinated fine solid particles (1)* (dispersion; solid content: 20%) | x g (See Table 1) |

The above-described fluorine-containing sufactant (1)* was the following compound:

$$C_8F_{17}SO_2\underset{\underset{C_3H_7}{|}}{N}CH_2COOK$$

The above-described dispersion (20%) of fluorinated fine solid particles (1)* was prepared in the following manner.

20 g of the fluorinated fine solid particles (1)* (an amount corresponding to 20 g in the case of the dispersion. The amount (78 ml) of water for use in dissolving gelatin was reduced so as to make the whole 100 g) was dispersed in a solution of 2 g of gelatin in 78 ml of water in a homogenizer at 10,000 rpm for 5 minutes by using 1 g of the fluorine-containing surfactant (1)*.

Preparation of thermal transfer image receiving material

A support obtained by laminating both sides of a paper having a basis weight of 180 g/m$^2$ with polyethylene containing titanium oxide dispersed therein, was coated with the above-described first to third layers in such an amount as to give wet film thicknesses of 20, 60 and 15 ml/m$^2$, respectively. The coated support was dried to obtain each of the thermal transfer image receiving materials 101 to 115 given in Table 1.

The thus-obtained thermal transfer dye providing material and thermal transfer image receiving material were placed upon each other in such a manner that the dye providing layer and the image receiving layer were brought into contact with each other. Printing was carried out from the side of the support of the thermal transfer dye providing material by using a thermal head under such conditions that the thermal head output was 0.25 W/dot, pulse width was 0.15 to 15 msec and dot density was 6 dots/mm. Magenta dye was imagewise transferred and fixed to the image receiving layer of the thermal transfer image receiving material.

PERFORMANCE EVALUATION

Heat fusion

An inspection was conducted to determine whether the dye providing layer of the dye providing material was peeled off and deposited on the surface of the resulting recorded thermal transfer image receiving material. The degree of deposition (heat fusion) of the peeled dye providing layer on the surface of the image receiving material was evaluated. The results are shown in Table 1. Criterion is as follows:

○: not deposited

Δ: The dye providing layer was partially deposited.

x: The dye providing layer was deposited on the whole surface of the image receiving material.

Feedability 50 sheets of fresh thermal transfer image receiving materials were put upon one another and automatically fed to a thermal transfer printer. The feedability and conveyability thereof were examined. The number of occasions where many sheets were fed at a time is shown in Table 1.

Color migration by re-transfer

The image receiving surface of the printed image receiving material and the image receiving surface of an unprinted (fresh) image receiving material were placed on each other in such a way that the image receiving surfaces were brought into contact with each other. A load of 500 g per 30 cm$^2$ was applied thereto. The materials were stored at 60° C. for one day under the load, were then peeled off from each other, and the degree of re-transfer of the dye image was evaluated. The results are shown in Table 1. Criterion is as follows.

○: little re-transferred.

Δ: somewhat re-transferred.

x: greatly re-transferred.

Fading of image

The transferred image receiving material was stored in a constant temperature air bath at 60° C. for one month. The blur of dye image was evaluated. The results are shown in Table 1. Criterion is as follows.

○: little blurred.

Δ: somewhat blurred.

x: greatly blurred.

TABLE 1

| Image receiving material No. | Fluorinated fine solid particles (1)* | | Silicone oil (1)* | | Performance evaluation | | | | Other |
|---|---|---|---|---|---|---|---|---|---|
| | Compound | x | Compound | a | Heat fusion | Feedability | Color migration by re-transfer | Fading of image | |
| 101 (Comp. Ex.) | — | — | — | — | X | 12 | ○-Δ | ○ | |
| 102 (Comp. Ex.) | Rublon ® L-2 | 10 | — | — | ○ | 4 | ○ | ○ | |
| 103 (Comp. Ex.) | " | 30 | — | — | ○ | 3 | ○ | ○ | |
| 104 (Comp. Ex.) | " | 90 | — | — | ○-Δ | 5 | ○ | ○ | reduction of gloss |
| 105 (Comp. Ex.) | — | — | SF 8421** | 6 | Δ | 7 | ○-Δ | ○ | |
| 106 (Comp. Ex.) | — | — | " | 12 | Δ | 5 | Δ | ○-Δ | |
| 107 (Comp. Ex.) | — | — | " | 24 | Δ | 6 | Δ-X | X | |
| 108 (Invention) | Rublon ® L-2 | 10 | " | 6 | ○ | 0 | ○ | ○ | |
| 109 (Invention) | " | 5 | " | 3 | ○ | 0 | ○ | ○ | |
| 110 (Invention) | " | 10 | SF 8410** | 6 | ○ | 0 | ○ | ○ | |
| 111 (Invention) | " | " | SH 3771** | 6 | ○ | 0 | ○ | ○ | |
| 112 (Invention) | " | " | SF 8416** | 6 | ○ | 0 | ○ | ○ | |
| 113 (Invention) | " | " | KF-100T** | 6 | ○ | 0 | ○ | ○ | |
| 114 (Invention) | " | " | X-22-3710** | 6 | ○ | 1 | ○ | ○ | |

TABLE 1-continued

| Image receiving material No. | Fluorinated fine solid particles (1)* Compound | x | Silicone oil (1)* Compound | a | Performance evaluation: Heat fusion | Feedability | Color migration by re-transfer | Fading of image | Other |
|---|---|---|---|---|---|---|---|---|---|
| 115 (Invention) | Teflon ® 30-J | " (solid content) | SF 8421** | 6 | ○ | 1 | ○ | ○ | |

**SF 8421: Epoxypolyether-modified silicone oil (manufactured by Toray Silicone KK)
SF 8410: Polyether-modified silicone oil (manufactured by Toray Silicone KK)
SH 3771: Polyether-modified silicone oil (manufactured by Toray Silicone KK)
SF 8416: Alkyl-modified Silicone oil (manufactured by Toray Silicone KK)
KF-100T: Epoxy-modified Silicone oil (manufactured by Shinetsu Silicone KK)
X-22-3710: Carboxy-modified Silicone oil (manufactured by Shinetsu Silicone KK)

It is apparent from Table 1 that when the fluorinated fine solid particles alone are used or when the amount thereof is increased, feedability is not satisfactorily improved, though heat fusion is improved. Particularly, an increase in the amount of the particles has such an adverse effect that the problem with regard to heat fusion grows serious, feedability is liable to be deteriorated and gloss is reduced.

When silicone oil alone is used or when the amount thereof is increased, feedability is not satisfactorily improved, though heat fusion is somewhat improved. An increase in the amount thereof has such adverse effects that color migration by re-transfer and the fading of image grow serious.

However, when the fluorinated fine solid particles and the silicone oil are used in combination according to the present invention, feedability is improved to such an extent that the feeding of many sheets of the materials at a time scarcely exists, heat fusion is sufficiently improved, color migration by retransfer and the fading of image does not exist and high-quality image having a high density can be obtained.

EXAMPLE 2

Preparation of thermal transfer image receiving material

The surface of a support (1) described hereinafter was coated with the following coating composition for an image receiving layer by means of wire bar coating in such an amount as to give a dry thickness of 10 μm to prepare each of the thermal transfer image receiving materials Nos. 201 to 220. The coated support was predried in a dryer and then dried in an oven at 100° C. for 30 minutes.

Coating composition for image receiving layer

| | |
|---|---|
| Polyester resin (Vylon 280, a product of Toyobo Co., Ltd) | 20 g |
| Methyl ethyl ketone | 95 ml |
| Toluene | 95 ml |
| Methoxypropylene glycol | 10 ml |
| Polyisocyanate (KP-90, a product of Dainippon Ink & Chemicals Inc.) | 1 g |
| Fluorinated fine solid particles (1)* | x g (See Table 2) |
| Silicone oil (1)* | a g (See Table 2) |
| Silicone oil (2)* (KF-857, a product of Shinetsu Silicone KK) | b g (See Table 2) |

The fluorinated fine solid particles (1)*, the silicone oil (1)* and the silicone oil (2)* used in the above-described composition are given in Table 2.

The fluorinated fine solid particles (1)* (in the case of powder) was added to the above-described coating composition and then dispersed therein in a homogenizer at 10,000 rpm for 5 minutes. When the particles in the form of a dispersion was added to the above-described coating composition, an increase in volume was adjusted by reducing the amounts of methyl ethyl ketone and toluene to be added.

Structure of support (1)

Gelatin layer of 0.2 μm in thickness

Low-density polyethylene layer of 15 μm in thickness

| | |
|---|---|
| A layer consisting of low-density polyethylene having a density of 0.923 g/cm$^3$ | 89.6 wt % |
| $TiO_2$ | 10 wt % |
| ultramarine | 0.4 wt % |

The paper of 170 μm in thickness

High-density polyethylene layer of 15 μm in thickness (a layer consisting of high-density polyethylene having a density of 0.96 g/m$^3$)

Gelatin layer of 0.2 μm in thickness (a layer consisting of gelatin, silica and alumina)

Preparation of thermal transfer dye providing material

A polyester film (Lumirror, a product of Toray Industries, Inc.) of 4.5 μm in thickness, which had a heat-resisting slip layer consisting of a thermosetting acrylic resin on one side thereof, was used as a support. The side opposite to the heat-resisting slip layer-side of the support was coated with the following ink compositions for the formation of a thermal transfer dye providing layer in order in such an amount as to give a coating weight of 1 g/m$^2$ on a dry basis, thus preparing a thermal transfer dye providing material.

| Cyan ink composition for the formation of thermal transfer dye providing layer | |
|---|---|
| Disperse dye (Kayazet Blue 714, a product of Nippon Kayaku Co., Ltd.) | 5 parts |
| Polyvinyl butyral resin (S-lec BX-1; a product of Sekisui Chemical Co., Ltd.) | 4 parts |
| Methyl ethyl ketone | 46 parts |
| Toluene | 45 parts |

| Magenta ink composition for the formation of thermal transfer dye providing layer | |
|---|---|
| Disperse dye (MS Red G, a product of Mitsui Toatsu Chemicals, Ink.) (Disperse Red 60) | 2.6 parts |
| Disperse dye | 1.4 parts |

-continued

| | |
|---|---|
| (Macrolex Violet R, a product of Bayer) (Disperse Violet 26) | |
| Polyvinyl butyral resin (S-lec BX-1, a product of Sekisui Chemical Co., Ltd.) | 4.3 parts |
| Methyl ethyl ketone | 45 parts |
| Toluene | 45 parts |
| Yellow ink composition for the formation of thermal transfer dye providing layer | |
| Disperse dye (Macrolex Yellow GG, a product of Bayer) (Disperse Yellow 201) | 5.5 parts |
| Polyvinyl butyral resin (S-lec BX-1, a product of Sekisui Chemical Co., Ltd.) | 4.5 parts |
| Methyl ethyl ketone | 45 parts |
| Toluene | 45 parts |

In the same way as in Example 1, thermal transfer was carried out by using these materials, and performance was evaluated. The results are shown in Table 2.

according to the present invention, the problems can be solved to a nearly perfect level.

According to the present invention, there can be obtained a thermal transfer image receiving material which is improved in feedability and conveyability, and has improved properties with regard to the problems of the heat fusion of a thermal transfer dye providing material during transfer the color migration by the retransfer of dye after transfer and the fading of the image after storing over a long period of time. Accordingly, an image having excellent picture quality and high density can be obtained.

While the invention has been described in detail and with reference to specific embodiments thereof, it will be apparent to one skilled in the art that various changes and modifications can be made therein without departing from the spirit and scope thereof.

What is claimed is:

1. A thermal transfer image receiving material comprising a support having thereon at least one image receiving layer which can accept a dye to form an image, said dye migrating from a thermal transfer dye providing material when heated, wherein the material contains at least one layer on the image receiving layer-side of the support, said at least one layer containing fine solid particles of a fluorine compound and silicone oil.

TABLE 2

| Image receiving material No. | Fluorinated fine solid particles (1)* | x | Silicone oil (1)* | a | (2)* | b | Performance evaluation: Heat fusion | Feedability | Color migration by re-transfer | Fading of image |
|---|---|---|---|---|---|---|---|---|---|---|
| 201 (Comp. Ex.) | — | — | — | — | — | — | X | 20 | ○ | ○ |
| 202 (Comp. Ex.) | Rublon ® L-2 | 0.4 | — | — | — | — | Δ | 5 | ○ | ○ |
| 203 (Comp. Ex.) | " | 0.8 | — | — | — | — | Δ | 7 | ○ | ○ |
| 204 (Comp. Ex.) | " | 1.6 | — | — | — | — | Δ | 5 | ○ | ○ |
| 205 (Comp. Ex.) | — | — | KF 857 | 0.5 | — | — | ○-Δ | 9 | ○ | ○ |
| 206 (Comp. Ex.) | — | — | " | 1.0 | — | — | ○-Δ | 10 | ○-Δ | ○-Δ |
| 207 (Comp. Ex.) | — | — | " | 2.0 | — | — | ○-Δ | 13 | Δ | Δ-X |
| 208 (Comp. Ex.) | — | — | " | 4 | — | — | Δ | 12 | X | X |
| 209 (Invention) | Rublon ® L-2 | 0.4 | KF 857 | 0.5 | — | — | ○ | 0 | ○ | ○ |
| 210 (Invention) | " | 0.4 | " | 1.0 | — | — | ○ | 2 | ○ | ○ |
| 211 (Invention) | " | 0.2 | " | 0.5 | — | — | ○ | 1 | ○ | ○ |
| 212 (Comp. Ex.) | — | — | KF-100T | 1.0 | — | — | ○-Δ | 14 | ○-Δ | ○ |
| 213 (Invention) | Rublon ® L-2 | 0.4 | " | 0.5 | — | — | ○ | 0 | ○ | ○ |
| 214 (Comp. Ex.) | — | — | KF-857 | 0.5 | SH 3771 | 0.5 | Δ | 8 | ○-Δ | ○ |
| 215 (Invention) | Rublon ® L-2 | 0.4 | " | 0.5 | " | 0.5 | ○ | 0 | ○ | ○ |
| 216 (Comp. Ex.) | — | — | " | 0.5 | KF 907 | 0.5 | Δ | 11 | ○ | ○ |
| 217 (Invention) | Rublon ® L-2 | 0.4 | " | 0.5 | " | 0.5 | ○ | 0 | ○ | ○ |
| 218 (Comp. Ex.) | — | — | SF 8416 | 1.0 | — | — | Δ | 10 | ○ | ○ |
| 219 (Invention) | Rublon ® L-2 | 0.4 | SF 8416 | 1.0 | — | — | ○ | 1 | ○ | ○ |
| 220 (Invention) | Rublon ® LD-1 | 0.4 (solid content) | KF-857 | 0.5 | SH 3771 | 0.5 | ○ | 1 | ○ | ○ |

It is apparent from Table 2 that when the fluorinated fine solid particles alone or the silicone oil alone is used or when the amount thereof is increased, the problems with regard to feedability and heat fusion can not be perfectly solved, but when they are used in combination 2. The thermal transfer image receiving material of claim 1, wherein the outermost layer of said at least one layer on the image receiving layer-side of the support is formed by coating a dispersion comprising a fluorine containing surfactant as a coating aid and drying a coated layer.

3. The thermal transfer image receiving material of claim 1, wherein the fluorine compound is a low-molecular weight compound or a high molecular weight compound.

4. The thermal transfer image receiving material of claim 1, wherein the fine solid particles of the fluorine compound have a particle diameter of 0.01 to 30 μm.

5. The thermal transfer image receiving material of claim 1, wherein the fine solid particles of the fluorine compound are used in an amount of 0.001 to 5 g/m$^2$.

6. The thermal transfer image receiving material of claim 1, wherein the silicone oil is an unmodified or modified silicone oil.

7. The thermal transfer image receiving material of claim 1, wherein the layer containing the silicon oil comprises a dye accepting polymer and a water-soluble binder, and the silicone oil is used in an amount of 0.1 to 50% by weight based on the combined amount of the dye accepting polymer and the water-soluble binder.

8. The thermal transfer image receiving material of claim 1, wherein the fine solid particles of the fluorine compound are selected from the group consisting of a tetrafluoroethylene resin, a tetrafluoroethylene telomer, a tetrafluoroethylene-hexafluoropropylene copolymer, a polyvinylidene fluoride and a trifluorinated ethylene chloride resin.

9. The thermal transfer image receiving material of claim 1, wherein the silicone oil is selected from the groups consisting of a carboxy-modified silicone oil, an amino-modified silicone oil, an epoxy-modified silicone oil, an polyetner-modified silicone oil and an alkyl-modified silicone oil.

10. The thermal transfer image receiving material of claim 1, wherein said support is a polyolefin-coated paper.

11. A thermal transfer image receiving material comprising a support having thereon at least one image receiving layer which can accept a dye to form an image, said dye migrating from a thermal transfer dye providing material when heated, wherein said image receiving layer is formed by coating a dispersion and drying a coated layer, said dispersion being formed by dissolving a substance capable of accepting the dye and silicone oil in a water incompatible organic solvent, emulsifying and dispersing the solution in an aqueous solution of a water-soluble binder and adding a dispersion of fine solid particles of a fluorine compound to the emulsified dispersion.

12. The thermal transfer image receiving material of claim 4, wherein said dispersion for the outermost layer of the image receiving layer further comprises a fluorine containing surfactant as a coating aid.

13. The thermal transfer image receiving material of claim 11, wherein the fluorine compound is a low-molecular weight compound or a high molecular weight compound.

14. The thermal transfer image receiving material of claim 11, wherein the fine solid particles of the fluorine compound have a particle diameter of 0.01 to 30 μm.

15. The thermal transfer image receiving material of claim 11, wherein the fine solid particles of the fluorine compound are used in an amount of 0.001 to 5 g/m$^2$.

16. The thermal transfer image receiving material of claim 11, wherein the silicone oil is an unmodified or modified silicone oil.

17. The thermal transfer image receiving material of claim 11, wherein the silicone oil is used in an amount of 0.1 to 50% by weight based on the combined amount of the substance capable of accepting the dye and the water-soluble binder which are contained in the layer to which the silicone oil is added.

18. The thermal transfer image receiving material of claim 11, wherein the fine solid particles of the fluorine compound are selected from the group consisting of a tetrafluoroethylene resin, a tetrafluoroethylene telomer, a tetrafluoroethylene-hexafluoropropylene copolymer, a polyvinylidene fluoride and a trifluorinated ethylene chloride resin.

19. The thermal transfer image receiving material of claim 11, wherein the silicone oil is selected from the group consisting of a carboxy-modified silicone oil, an amino modified silicone oil, an epoxy-modified silicone oil, an polyether-modified silicone oil and an alkyl-modified silicone oil.

20. The thermal transfer image receiving material of claim 11, wherein said support is a polyolefin-coated paper.

21. A thermal transfer image receiving material comprising a support having thereon at least one image receiving layer which can accept a dye to form an image, said dye migrating from a thermal transfer dye providing material when heated, wherein said image receiving layer is formed by coating a dispersion and drying a coated layer, said dispersion being formed by emulsifying and dispersing a solution of silicone oil in an organic solvent in a mixture of a latex of a substance capable of accepting the dye or an aqueous solution of a water-soluble substance capable of accepting the dye and an aqueous solution of a water-soluble binder and adding a dispersion of fine solid particles of a fluorine compound to the emulsified dispersion.

22. The thermal transfer image receiving material of claim 21, wherein said dispersion for the outermost layer of the image receiving layer further comprises a fluorine containing surfactant as a coating aid.

23. The thermal transfer image receiving material of claim 21, wherein the fluorine compound is a low-molecular weight compound of a high molecular weight compound.

24. The thermal transfer image receiving material of claim 21, wherein the fine solid particles of the fluorine compound have a particle diameter of 0.01 to 30 μm.

25. The thermal transfer image receiving material of claim 21, wherein the fine solid particles of the fluorine compound are used in an amount of 0.001 to 5 g/m$^2$.

26. The thermal transfer image receiving material of claim 21, wherein the silicone oil is an unmodified or modified silicone oil.

27. The thermal transfer image receiving material of claim 21, wherein the silicone oil is used in an amount of 0.1 to 50% by weight based on the combined amount of the substance capable of accepting the dye and the water-soluble binder which are contained in the layer to which the silicone oil is added.

28. The thermal transfer image receiving material of claim 21, wherein the fine solid particles of the fluorine compound are selected from the group consisting of a tetrafluoroethylene resin, a tetrafluoroethylene telomer, a tetrafluoroethylene-hexafluoropropylene copolymer, a polyvinylidene fluoride and a trifluorinated ethylene chloride resin.

29. The thermal transfer image receiving material of claim 21 wherein the silicone oil is selected from the group consisting of a carboxy-modified silicone oil, an amino-modified silicone oil, an epoxy-modified silicone oil, an polyether-modified silicone oil and an alkyl-modified silicone oil.

30. The thermal transfer image receiving material of claim 21, wherein said support is a polyolefin-coated paper.

* * * * *